US006326073B1

(12) United States Patent
Sager et al.

(10) Patent No.: US 6,326,073 B1
(45) Date of Patent: Dec. 4, 2001

(54) PRESEAMED SHEET FLOORING PRODUCT

(75) Inventors: Jennifer W. Sager, Salunga; Ronald S. Lenox, Lancaster; George L. Lilley, Manheim; Robert K. Keener, Lititz, all of PA (US)

(73) Assignee: Armstrong World Industries, Inc., Lancaster, PA (US)

( * ) Notice: Subject to any disclaimer, the term of this patent is extended or adjusted under 35 U.S.C. 154(b) by 0 days.

(21) Appl. No.: 09/298,287

(22) Filed: Apr. 23, 1999

(51) Int. Cl.[7] ..... B32B 3/14

(52) U.S. Cl. ..... 428/58; 428/47; 428/48; 428/49; 428/57; 428/908.8

(58) Field of Search ..... 428/57, 58, 59, 428/908.8, 44, 45, 46, 47, 48, 49, 50, 51, 52, 53, 54, 55, 56; 156/502, 505, 508, 509

(56) References Cited

U.S. PATENT DOCUMENTS

| | | | | |
|---|---|---|---|---|
| 3,319,392 | * | 5/1967 | Fitzgerald | 52/389 |
| 3,360,422 | * | 12/1967 | Desch | 161/89 |
| 3,950,581 | * | 4/1976 | Maurin | 428/49 |
| 4,096,123 | | 6/1978 | Niinami et al. | 260/75 |
| 4,100,318 | * | 7/1978 | McCann et al. | 428/159 |
| 4,193,957 | * | 3/1980 | Kauffman et al. | 264/46.4 |
| 4,204,987 | | 5/1980 | Streets et al. | 260/29.2 |
| 4,340,526 | | 7/1982 | Petke et al. | 524/292 |
| 4,423,106 | | 12/1983 | Mahn | 428/207 |
| 4,581,093 | | 4/1986 | Noyes et al. | 156/307.3 |
| 4,857,065 | | 8/1989 | Seal | 604/368 |
| 4,931,342 | | 6/1990 | Tolbert et al. | 428/90 |
| 4,975,477 | | 12/1990 | Cox et al. | 524/77 |
| 5,725,722 | | 3/1998 | Eshleman | 156/502 |
| 5,763,096 | | 6/1998 | Takahashi et al. | 428/480 |
| 5,942,300 | * | 8/1999 | Lukowski, Sr. | 428/40.1 |

* cited by examiner

*Primary Examiner*—Blaine Copenheaver
*Assistant Examiner*—Alicia Chevalier
(74) *Attorney, Agent, or Firm*—Adams, Schwartz & Evans, P.A.

(57) ABSTRACT

A preseamed sheet flooring product having first and second sheet products positioned closely adjacent each other edge-to-edge to form a seam therebetween. An adhesive is positioned in the seam and has visual characteristics suitable for creating an indistinct appearance of the seam in the sheet flooring product. The seam also has wear characteristics sufficiently similar to wear characteristics of the sheet flooring product to maintain the visually indistinct appearance of the adhesive on the surface of the seam as wear occurs to the end product sheet material.

9 Claims, 5 Drawing Sheets

PRESEAMED SHEET FLOORING PRODUCT

TECHNICAL FIELD AND BACKGROUND OF THE INVENTION

This invention relates to a preseamed sheet flooring product and method of constructing a preseamed sheet flooring product. The invention has particular application in the formation of sheet flooring products for spanning floor widths which are greater than the width of typical commercially-manufactured sheet flooring products. Flooring products made in accordance with the disclosure of this application can be used to cover floors which heretofore have been covered with resilient flooring products which, because they are narrower than the floor to be covered, are seamed in situ by installation technicians as the floor is being installed. Use of the term "preseamed" in this application therefore refers to flooring products which are constructed of flooring products which may themselves be end products when seamed together during installation, but which have been seamed together during the manufacturing process, and thereafter shipped for later installation.

The novel features of the invention include processing techniques which permit efficient joining of the sheet products. The appearance and wear characteristics of the seam according to the invention render the seam sufficiently visually indistinct so as to be invisible except under careful scrutiny, and with the same wear characteristics as the flooring material itself.

The invention includes use of a class of adhesives which allows sections of flooring materials to be joined to form one or more free-floating sealed joints prior to the installation of the finished product. The flooring materials can comprise combinations of a wear layer, foam interlayer or core, a glass reinforced layer, and a nonfoamed or reinforced backing or a felt.

Normally, when a resilient sheet floor is installed in a room wider that the resilient flooring itself, the installer must create a joined seam as the floor is installed. The width of resilient flooring is limited by the size of machinery available for the manufacturing process. Such seams in a flooring structure can be undesirable due to many problems associated with installation and performance of the floor seam. These problems may include poor seaming techniques utilized by installers. These can cause the seams to pull apart or separate from the subfloor, and act as a trap for soil, food and beverage spills and the like. Separated seams also present an unattractive appearance.

Current commercially available seaming materials used by flooring installers include solvent-type welding systems, molten polymers or two-part urethane coatings which are used to seal the seam of the floor after it has been completely installed. Such seams are not sufficiently strong to withstand handling inherent in the manufacture, shipping and installation of the flooring product. In many instances the adhesives are not sufficiently strong to effectively bond all layers of a flooring structure.

For example, commercially available homogeneous sheet flooring materials are often seamed after installation by routing a groove along the seam line. A homogenous adhesive material similar in composition to the composition of the sheet flooring is heated in a tool and is then directed into the routed seam. This homogenous adhesive material is allowed to cool. The excess adhesive is then scived off in order to level the seam area with the remaining floor. This type of adhesive seam often disrupts the evenness and pattern consistency of the floor.

SUMMARY OF THE INVENTION

Therefore, it is an object of the invention to provide a preseamed sheet flooring material having a predetermined width suitable for installation on a floor and providing the appearance and wear characteristics of a seamless floor.

It is another object of the invention to provide a preseamed sheet flooring material wherein the seaming adhesive has the wear characteristics of the sheet flooring material.

It is another object of the invention to provide a preseamed sheet flooring material wherein the seaming adhesive bonds aggressively to all layers of a multi-layer sheet flooring material.

It is another object of the invention to provide a preseamed sheet flooring material wherein the seam is sufficiently strong to withstand separation during subsequent manufacturing steps, shipment, storage and installation.

It is another object of the invention to provide a preseamed sheet flooring material which requires reduced installation labor.

It is another object of the invention to provide a preseamed sheet flooring material which avoids costs resulting from improper seaming during installation.

It is another object of the invention to provide a preseamed sheet flooring material wherein the seaming adhesive has the staining characteristics of the sheet flooring material.

It is another object of the invention to provide a preseamed sheet flooring material wherein two or more sheet products are joined by seams as a n integral part of the manufacturing process to produce an end product which can be installed without an in situ seaming operation.

It is another object of the invention to provide a method of forming a preseamed sheet flooring material having a predetermined width suitable for installation on a floor and providing the appearance and wear characteristics of a seamless floor.

It is another object of the invention to provide a method of forming a preseamed sheet flooring material having a predetermined width suitable for installation on a floor wherein the seam fills with adhesive as a result of capillary flow during a pressure-applying step.

These and other objects of the present invention are achieved in the preferred embodiments disclosed below by providing a preseamed sheet flooring product comprising first and second sheet products positioned closely adjacent each other edge-to-edge to form a seam therebetween. An adhesive is positioned above, below or in the seam. The adhesive has visual characteristics suitable for creating an indistinct appearance of the seam in the sheet flooring product and also having wear characteristics sufficiently similar to wear characteristics of the sheet flooring product to maintain the visually indistinct appearance of the adhesive on the surface of the seam as wear occurs to the end sheet flooring product.

According to one preferred embodiment of the invention, the first and second sheet products have a decorative surface including a pattern, wherein the first and second sheet products are positioned closely adjacent each other edge-to-edge to form a seam therebetween with the pattern on the first and second sheets in matching orientation with each other.

According to another preferred embodiment of the invention, the adhesive comprises a hot melt adhesive.

According to yet another preferred embodiment of the invention, the edges of the first and second sheet products are shaped to define, when positioned closely adjacent each other, a predetermined void within the seam for retaining the adhesive therein.

According to yet another preferred embodiment of the invention, the seam between the first and second sheet products is between 10 and 100 microns in width.

According to yet another preferred embodiment of the invention, the sheet flooring product comprises wear layer, interlayer and backing layer.

According to yet another preferred embodiment of the invention, the wear layer comprises PVC.

According to yet another preferred embodiment of the invention, the adhesive comprises a hot melt adhesive applied to the seam in tape form and forced into the seam by heat and pressure.

According to yet another preferred embodiment of the invention, the adhesive comprises a hot melt adhesive applied to the seam in powder form and forced into the seam by heat and pressure.

According to yet another preferred embodiment of the invention, the adhesive comprises a hot melt adhesive applied to the seam in scrim form and forced into the seam by heat and pressure.

According to yet another preferred embodiment of the invention, the adhesive comprises a hot melt adhesive applied to the seam in rope form and forced into the seam by heat and pressure.

According to yet another preferred embodiment of the invention, the adhesive comprises a hot melt adhesive applied to the seam in tape form and exposed to sufficient heat and pressure to initiate capillary flow of the adhesive into the seam.

According to yet another preferred embodiment of the invention, the adhesive comprises a hot melt adhesive applied to the seam in powder form and exposed to sufficient heat and pressure to initiate capillary flow of the adhesive into the seam.

According to yet another preferred embodiment of the invention, the adhesive comprises a hot melt adhesive applied to the seam in scrim form and exposed to sufficient heat and pressure to initiate capillary flow of the adhesive into the seam.

Preferably, the adhesive comprises a hot melt adhesive applied to the seam in rope form and exposed to sufficient heat and pressure to initiate capillary flow of the adhesive into the seam.

An embodiment of the method of forming preseamed sheet flooring material having a predetermined width suitable for installation on a floor and providing the appearance and wear characteristics of a seamless floor according to the invention comprises the steps of positioning first and second sheet products closely adjacent each other edge-to-edge to form a seam therebetween, applying an adhesive onto the seam, the adhesive having visual characteristics suitable for creating an indistinct appearance of the seam in the completed preseamed flooring material. Pressure is applied to the adhesive to force the adhesive into the seam. The adhesive is cured to thereby permanently bond the first and second sheet products together. The preseamed flooring product is placed into a compact configuration suitable for storage and shipment prior to installation on a floor.

According to one preferred embodiment of the invention, the first and second sheet products have a decorative surface including a pattern, and wherein the method includes the step of positioning the first and second sheet products closely adjacent each other edge-to-edge to form a seam therebetween with the pattern on the first and second sheets in matching orientation with each other.

According to another preferred embodiment of the invention, the method includes the optional step of removing any adhesive remaining outside of the seam after curing.

According to yet another preferred embodiment of the invention, the step of applying an adhesive to the seam comprises the step of applying a release paper, having an adhesive coated thereon, to the seam.

According to one preferred embodiment of the invention, the adhesive comprises a hot melt adhesive, and the method includes the step of applying heat to the adhesive to melt the adhesive sufficiently to cause the adhesive to enter the seam.

According to yet another preferred embodiment of the invention, the method includes the step of applying simultaneous heat and pressure to the adhesive.

According to another preferred embodiment of the invention, the adhesive has wear characteristics sufficiently similar to wear characteristics of the sheet flooring material to maintain the visually indistinct appearance of the adhesive on the surface of the seam as wear occurs to the sheet flooring material.

According to yet another preferred embodiment of the invention, the step of applying an adhesive onto the seam comprises the step of applying to at least one side of the seam a hot melt adhesive tape having sufficient width to bridge the seam and a predetermined adjacent strip of the first and second sheet products.

According to yet another preferred embodiment of the invention, the method includes the step of applying a release paper to the hot melt adhesive tape.

According to yet another preferred embodiment of the invention, the method includes the step of sandwiching the hot melt adhesive tape and seam between first and second release papers.

According to yet another preferred embodiment of the invention, the method includes the step of shaping the edges of the first and second sheet products to define, when positioned closely adjacent each other, a predetermined void within the seam for retaining adhesive therein.

According to yet another preferred embodiment of the invention, the step of applying an adhesive onto the seam comprises the step of applying first and second strips of hot melt adhesive material to respective front and back surfaces of the first and second sheet products in overlapping relation to the seam.

According to yet another preferred embodiment of the method according to the invention, the strips of hot melt adhesive material comprise a hot melt adhesive tape.

According to yet another preferred embodiment of the method according to the invention, the strips of hot melt adhesive material comprise a hot melt adhesive scrim.

According to yet another preferred embodiment of the method according to the invention, the adhesive comprises a rope of hot melt adhesive, and the step of applying the adhesive to the seam includes the step of placing the rope on top of the seam in position to be forced into the seam by pressure.

According to yet another preferred embodiment of the method according to the invention, the step of applying an adhesive onto the seam comprises the step of applying a hot melt adhesive powder into the seam.

According to yet another preferred embodiment of the invention, the step of applying an adhesive comprises the step of applying a molten hot melt adhesive onto the seam, and further wherein the step of applying pressure to the adhesive to force the adhesive into the seam takes place while the adhesive is in its molten state.

Another method of forming a preseamed sheet flooring material having a predetermined greater width suitable for installation on a floor having a width greater than the width of either of the first or second sheets comprises the steps of positioning first and second sheet products closely adjacent each other edge-to-edge to form a seam therebetween and applying an adhesive onto the seam, the adhesive having visual characteristics suitable for creating an indistinct appearance of the seam in the completed end product sheet, and a viscosity sufficiently low to enable the adhesive to flow by capillary action into the seam. Pressure is applied to the adhesive sufficient to initiate capillary flow of the adhesive into the seam. The adhesive is cured to thereby permanently bond the first and second sheet products together.

DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
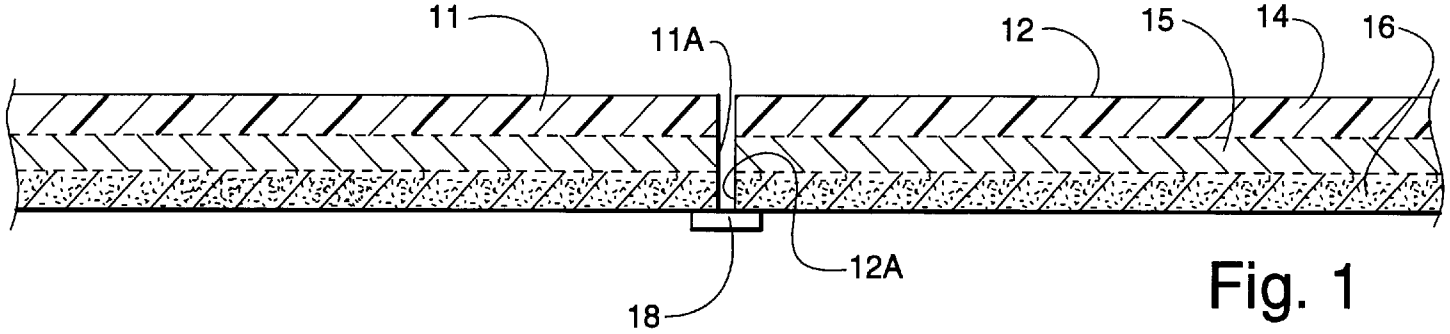
FIG. 1 is a vertical cross-sectional view of first and second sheet products placed adjacent each other to form a seam ready to receive an adhesive.

In general, the product and method according to the invention utilize cut edges of sheet products which are positioned together to form a seam for receiving an adhesive. The adhesive can comprise a polyester, polyamide or other polar polymeric material which can serve as an effective adhesive for the sheet flooring material. The adhesive is preferably a hot melt adhesive which melts between 60° C. and 250° C. It is characterized by high adhesion to all layers of the floor structure such as a wear layer, foam interlayer or core, a glass reinforced layer, and a non-foamed or reinforced backing, or felt. The adhesive must have wear and staining characteristics similar to the wear layer of the floor in which it is used. The adhesive may be clear, white or pigmented to match the surface color of the flooring. The adhesive may be in the form of a powder, a meltable scrim, a tape or an extruded profile and may contain a reinforcing material such as fibers or woven or non-woven webs such as glass or polyester. The adhesive must also be flexible enough to allow for rolling of a sheet floor into a cylinder without chipping, cracking, breaking or peeling of the adhesive, as is done after manufacturing is complete in preparation for shipment and storage. The adhesive seam joint must also be strong enough to resist normal forces encountered during installation and usage of the floor under normal circumstances.

The placement of the adhesive may be below, in, or above the seam so that when activated by heat, applied pressure will cause the molten adhesive to flow completely through the seam or joint. The applied pressure and heat can be transferred to the seam area by a tool made of flexible or rigid material such as metal, metal/paper composite, or other material that can tolerate the heat of the seaming process. A paper or film that has a release coating such as polypropylene may be used to facilitate removing the tool without sticking.

The tool used to apply heat and pressure to the seam area should allow for directed pressure and heat to penetrate the seam area and should be of a defined shape so that it does not interfere with the visual elements of the floor structure. For example, application of direct pressure and heat cannot be applied by using a simple flat press that is significantly wider than the area to be adhered if the application of heat and pressure destroys or modifies visual elements important to the end user of the floor. The temperature of the tool can be between 60° C. and 350° C. Adequate pressure is applied according to the thickness of the structure being seamed, so that the adhesive will transfer and bond throughout the structure. To hold the seam in place during melting of the hot melt adhesive, several methods may be employed. For example, the two sheet products may be held in place by use of a vacuum device or a strip of tape until the adhesive is applied and cured to form the permanent seam.

Release of the resilient floor seam from the tool or tools used to apply pressure is accomplished by coating the surface of tools, if necessary, with a coating such as polypropylene which will not bond with the hot melt adhesive. The floor structure is then cooled and, if required, rolled for storage or shipment. Preseamed flooring can also be made to indefinite widths and can contain, if desired, inset decorations which have been cut and inserted into the host sheet.

EXAMPLE NO. 1

Consistent with the foregoing general description, the following examples illustrate products and process steps which enable the invention according to this application.

Referring now specifically to FIGS. 1–4 of the drawings, a preseamed sheet flooring product 10 (see FIG. 4) was prepared from two sheets 11 and 12 of a flooring product, specifically Armstrong's Midstar® Resilient Sheet Flooring. Cut edges 11A and 12A were positioned together to form a narrow seam 13. The sheets 11 and 12 were each formed of a 15 mil PVC wear layer 14, a 20 mil foam inter-layer 15, and a 22 mil non-woven felt backing layer 16.

A hot melt adhesive 18 of 5186PE polyester in sheet form manufactured by Bostick, Inc. of Middleton, Mass. was slit to ½ in. width to form a tape. The thickness of the tape was between 10 and 12 mils. The tape of adhesive 18 was then positioned on the underside of the sheets 11 and 12 beneath the seam 13, as shown in FIG. 1.

The polyester adhesive 18 is produced from adipic acid and 1,4-cyclohexane diol with an approximate melting temperature of 100° C.

Figure 2:
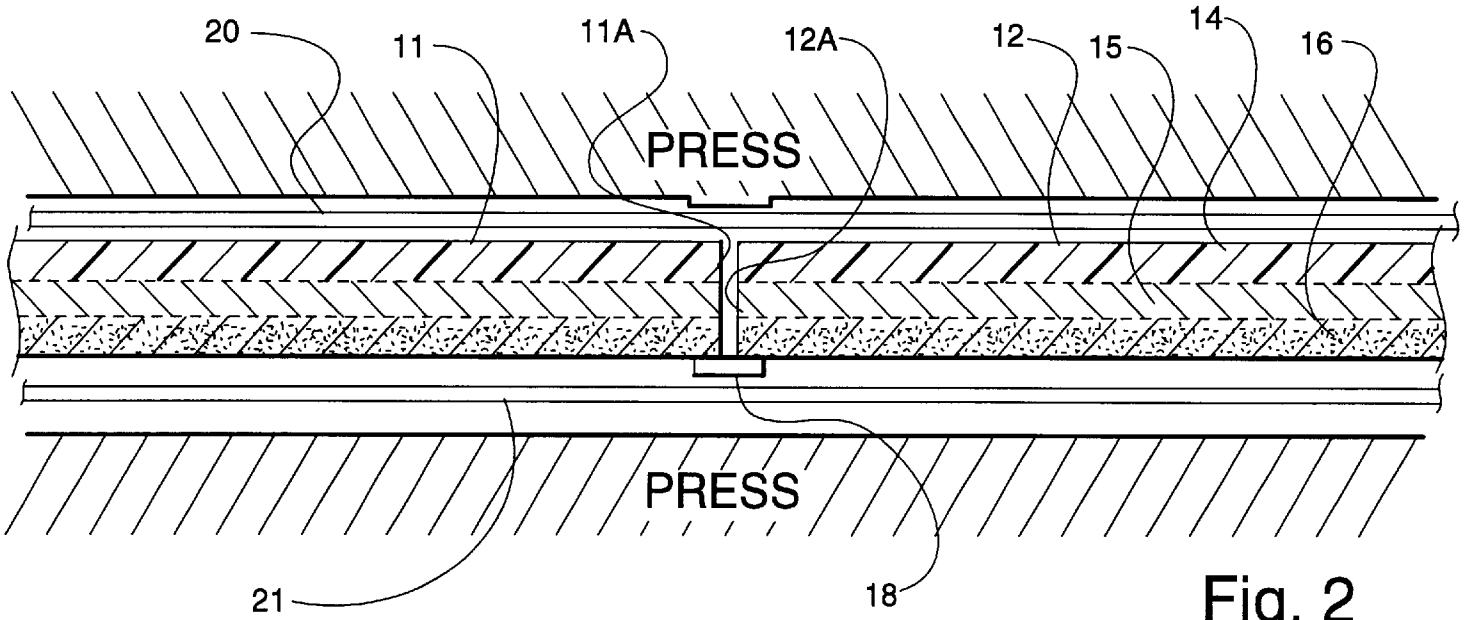
FIG. 2 is a partially exploded vertical cross-sectional view of the sheet products in FIG. 1 in preparation for the adhesive being introduced into the seam.
Figure 3:
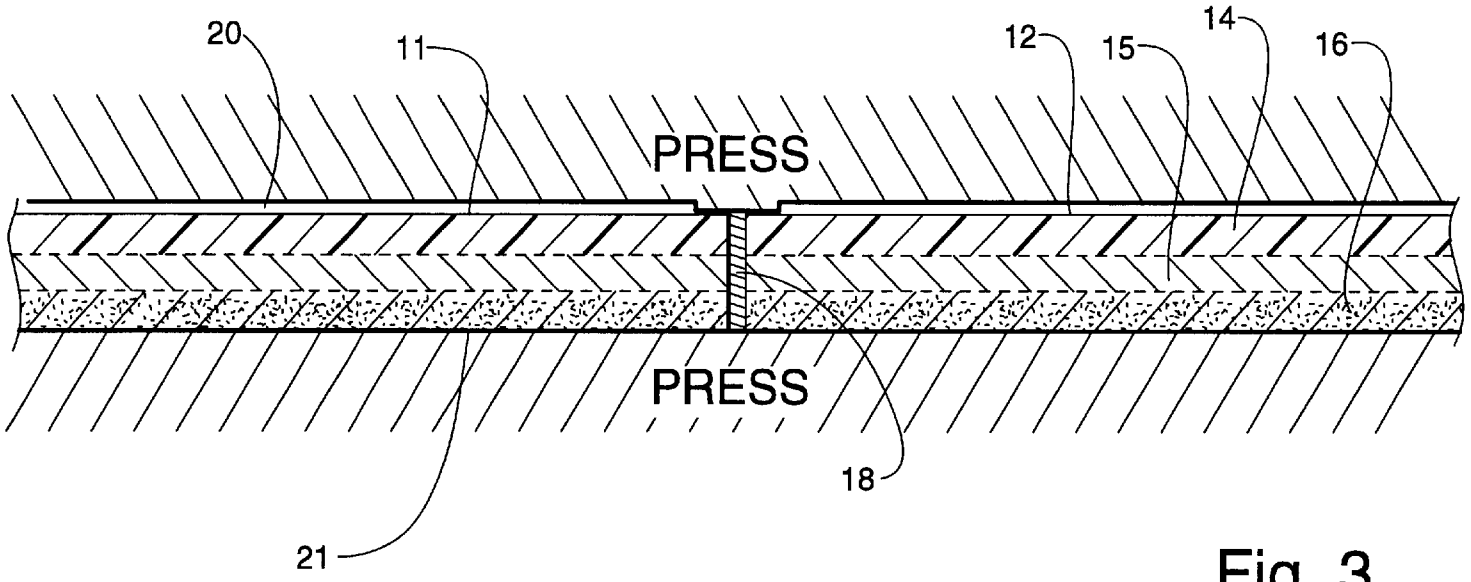
FIG. 3 is a vertical cross-sectional view of the sheet products after pressure and heat has filled the seam with adhesive.
Figure 4:
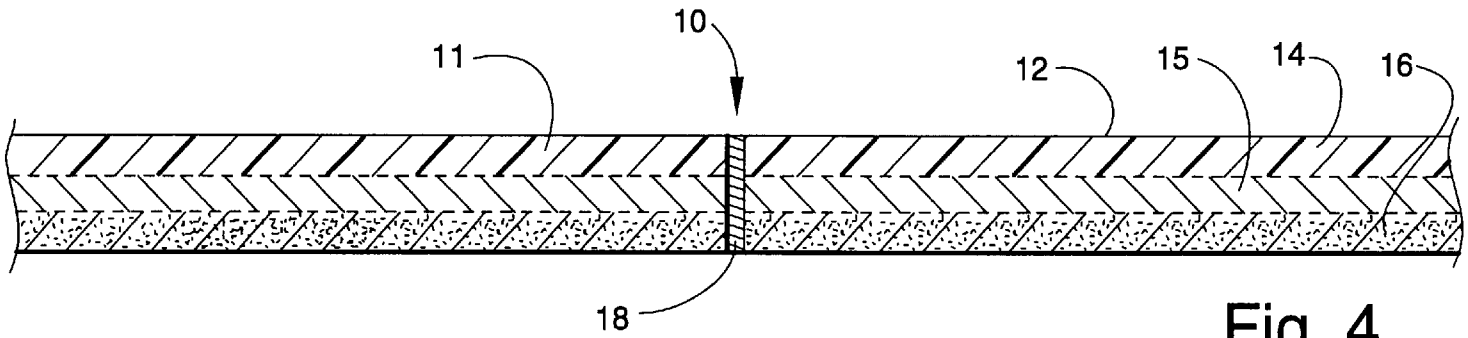
FIG. 4 is a cross-sectional view of the completed seam after removal of the release paper.
Figure 5:
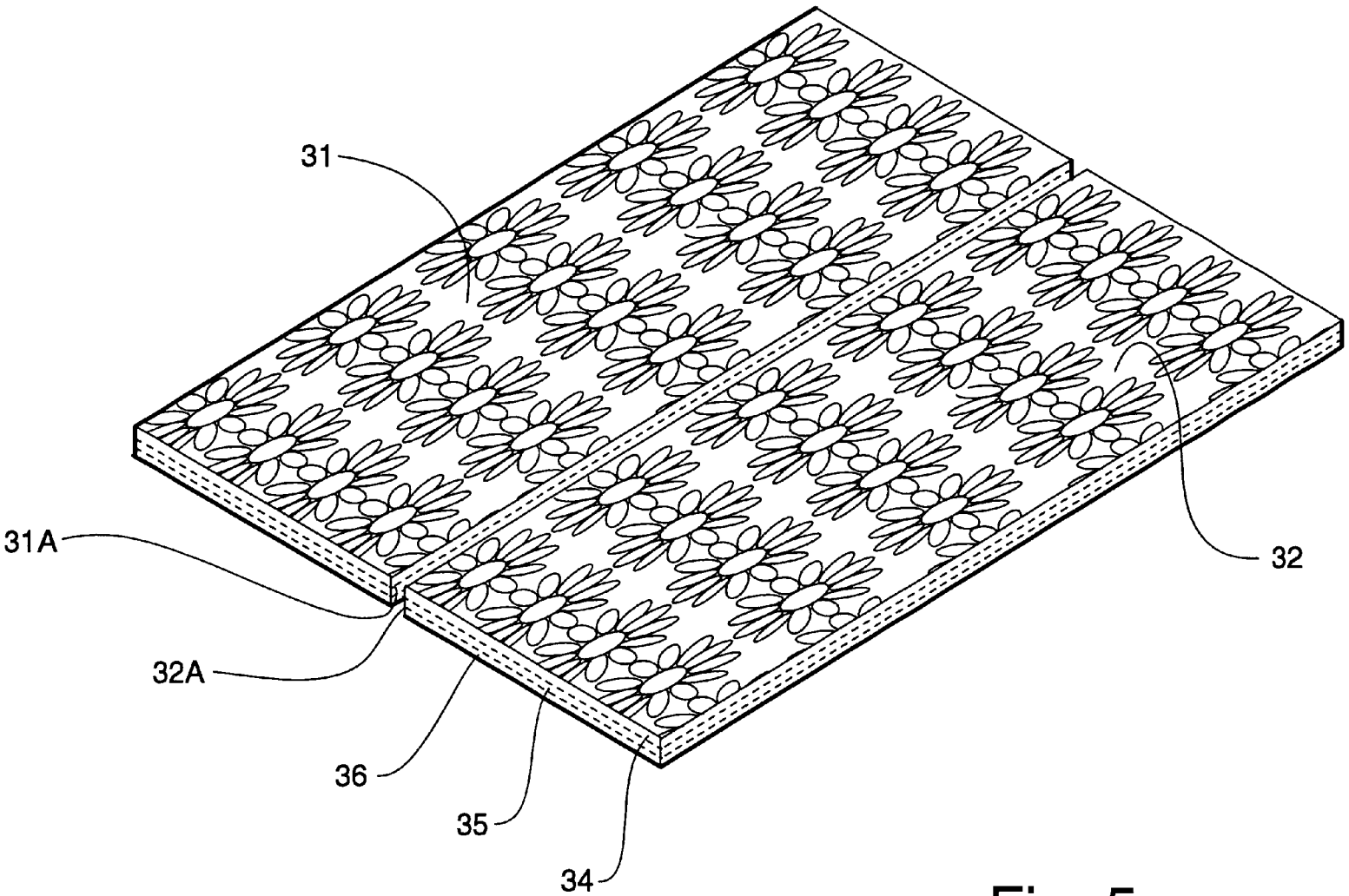
FIG. 5 is a fragmentary perspective view of first and second pattern-matched sheet products positioned adjacent each other to define a seam.

As is shown in FIG. 2, the prepared area around the seam 13 was then sandwiched between two pieces of polypropylene release paper 20, 21. The prepared area was then heated and pressed in a Wabash press fitted with a tool that allowed heat and pressure to come in contact with the prepared seam area. The press temperature was 110° C. Pressure at about 25 psi was applied for 12 seconds. The heat melted the adhesive 18 which flowed by capillary action upwardly into the seam 13, creating an intimate bond with each of the elements of the sheets 11 and 12, as is shown in FIG. 3.

The sheet flooring product 10 was removed from the press and allowed to cool. As used in the claims, the term "curing" includes the cooling process by which the hot melt adhesive solidifies and is thus able to provide the bond required to maintain the two sheets 11 and 12 in a permanently joined condition. After cooling, the release paper sheets 20 and 21 were removed, leaving a completed sheet flooring material 10. A cross-section of the adhesive-filled seam 13 was examined under a 20×microscope. The seam 13, filled with the adhesive 18 was measured to be 20–50 microns in width. The sheet flooring product 10 was then tested for breaking strength across the seam 13 using FTMS 501A test method 4111. The flooring product 10 exhibited 90% of the strength of the unjoined sheet products 11 and 12. The adhesive 18 exhibited staining and wear characteristics similar to the PVC wear layer 14 of the sheet flooring product 10. The sheet flooring product 10 was also tested for washability and passed a test of 52 washings with Armstrong's Once'n Done® Cleaner. No degradation of the seam was observed.

EXAMPLE NO. 2

As is shown in FIGS. 5–8, a preseamed sheet flooring product 30 (see FIG. 8) is prepared from two sheets 31 and 32 of a flooring product, specifically Armstrong's Midstar® Resilient Sheet Flooring. The cut edges 31A and 32A were positioned together and the pattern matched to form a narrow seam. The sheets 31 and 32 were each formed of a 15 mil PVC wear layer 34, a 20 mil foam inter-layer 35, and a 22 mil non-woven felt backing layer 36.

A polyester hot melt adhesive 38, type 5186PE, manufactured by Bostick, Inc, which was extruded into a 1 mm rope. The rope of adhesive 38 was then positioned over the top of the cut seam 33. A commercially available adhesive tape 39 was then positioned on the back side of the seam 33 and adjacent areas of the sheet products 31 and 32 to add support to the seam 33 during processing.

Figure 6:
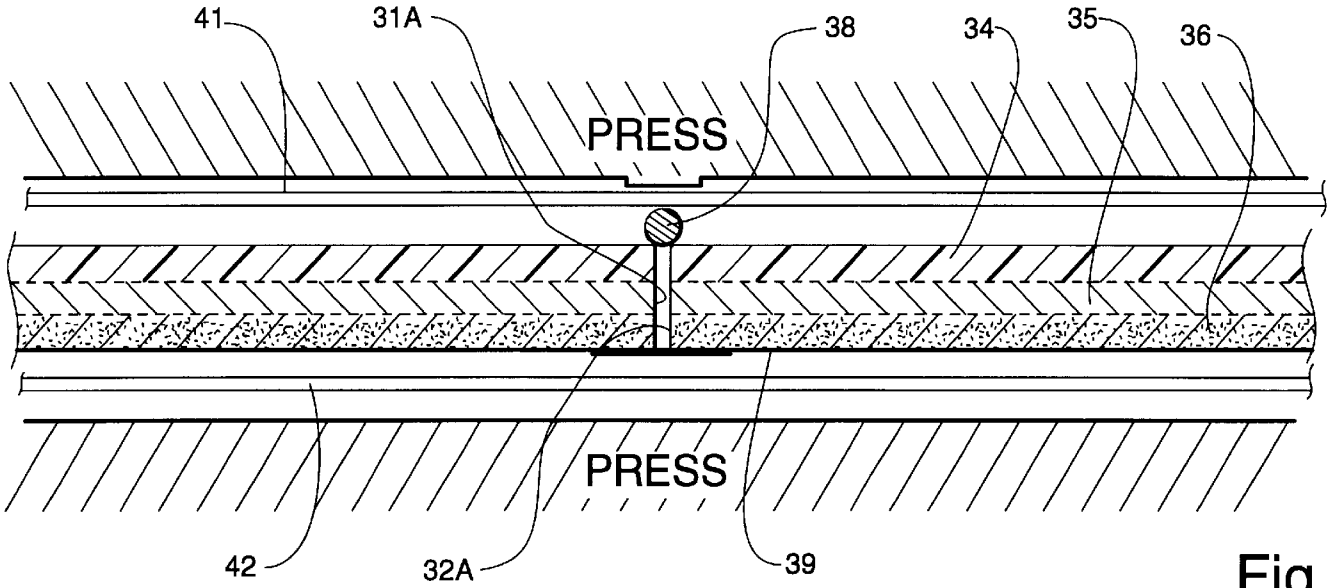
FIG. 6 is a partially exploded vertical cross-sectional view of the sheet products in FIG. 1 in preparation for a rope of adhesive on top of the seam to be introduced into the seam.
Figure 7:
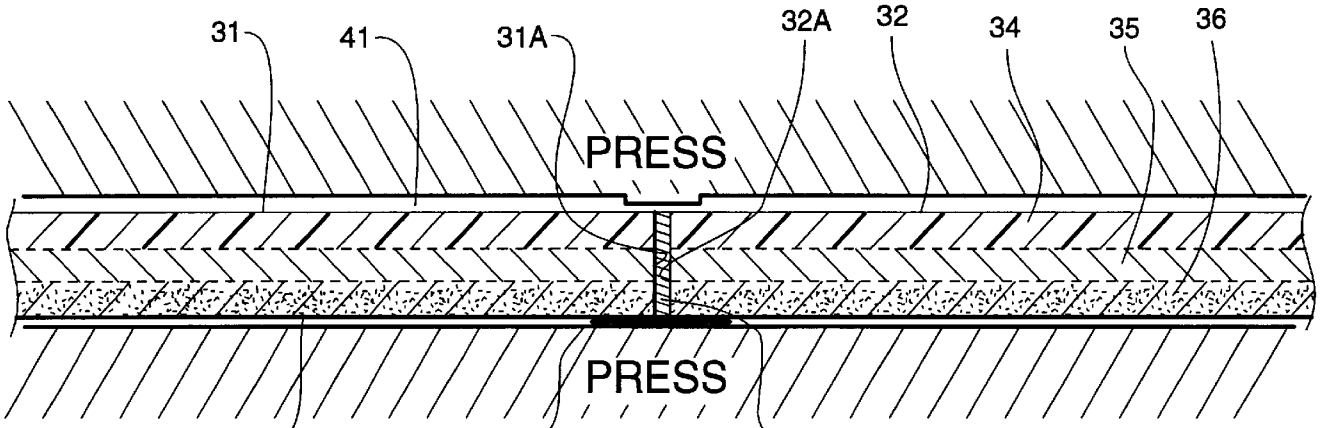
FIG. 7 is a vertical cross-sectional view of the sheet products after pressure and heat has filled the seam with adhesive.
Figure 8:
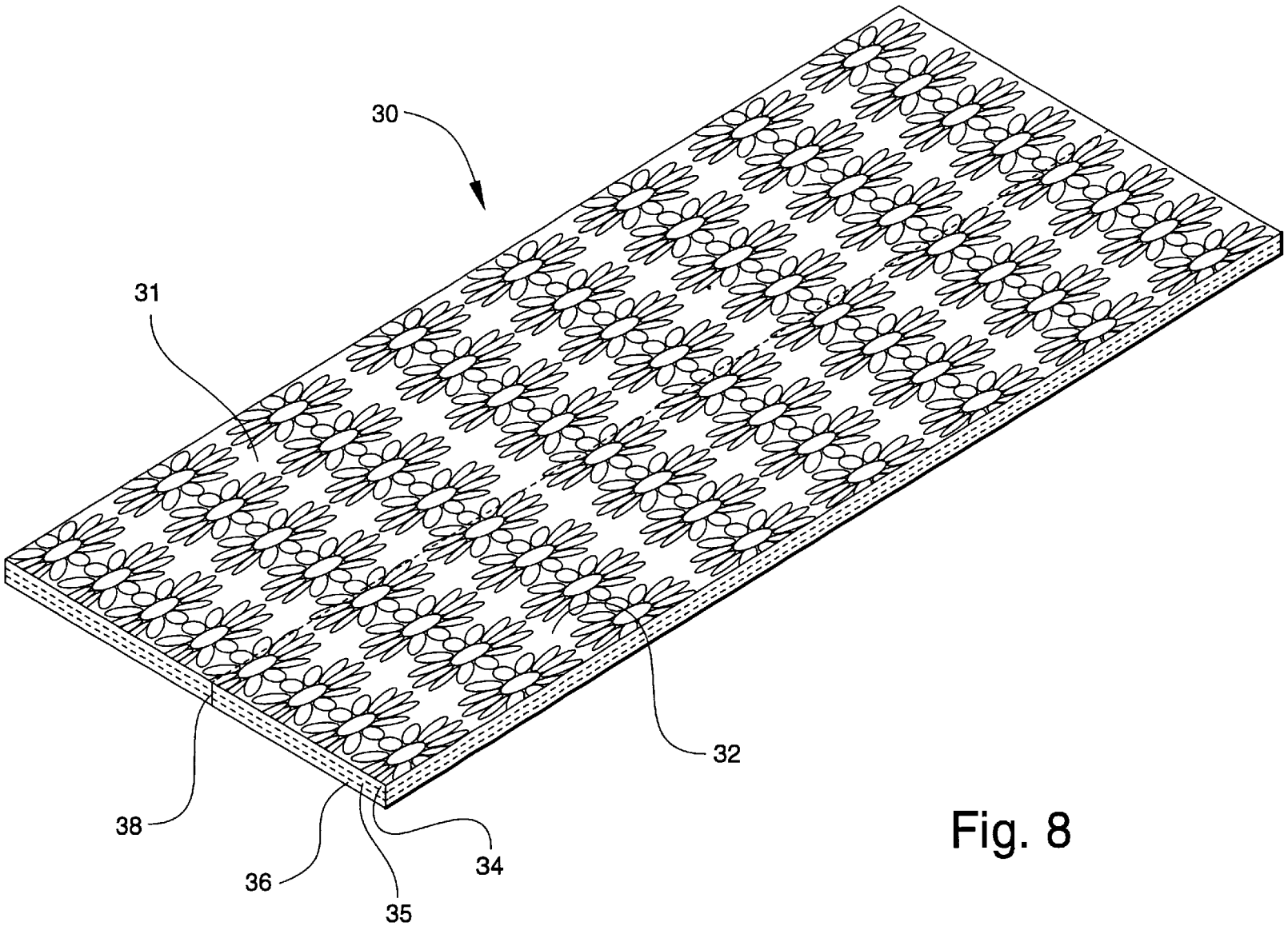
FIG. 8 is a fragmentary perspective view of the completed preseamed sheet flooring product.

As is shown in FIG. 6, the prepared area around the seam 33 was then sandwiched between two pieces of polypropylene release paper 41, 42. The prepared area was then heated and pressed in a Wabash press fitted with a tool that allowed heat and pressure to come in contact with the prepared seam area. The press temperature was 110° C. Pressure at about 25 psi was applied for 12 seconds. The heat melted the rope of adhesive 38 which flowed into the seam 33, creating an intimate bond with each of the elements of the sheets 31 and 32, as is shown in FIG. 7.

The sheet flooring product 30 was removed from the press and allowed to cool. After cooling, the release paper sheets 41 and 42 were removed, leaving a completed sheet flooring material 30. Consistent with the observed results of Example 1, the seam 33 was joined sufficiently to hold the sheet products 31 and 32 together and provide a completely sealed seam area.

EXAMPLE NO. 3

Two sections of sheet flooring products were positioned together to form a narrow cut seam, and the visual pattern matched. The sheet flooring product used was Armstrong's Midstar® Resilient Sheet Flooring. The sheets are each formed of a 15 mil PVC wear layer a 20 mil foam inter-layer and a 22 mil non-woven felt backing layer. A hot melt adhesive powder, 5186PE, a polyester adhesive manufactured by Bostick, Inc., was applied over a non-woven glass mat and heated to coat the mat with a film of the adhesive. The resulting laminate was slit into a ½ in. width tape. The tape was then positioned on the underside of the sheet products beneath the cut seam.

The seam to be adhered was then sandwiched between two pieces of polypropylene release paper. The prepared seam was then heated and pressed in a Wabash press fitted with a tool that allowed heat and pressure to come in contact with the prepared seam. The press temperature was 110° C. A minimum pressure of 25 psi was applied for 12 seconds. The pressure together with capillary action forced the hot melt adhesive into contact with all of the elements of the flooring structure.

The sample was then removed from the press and allowed to cool. Upon cooling, the release paper was removed. The seam area exhibited a tight, well sealed seam.

EXAMPLE NO. 4

Two sections of sheet flooring products were positioned together to form a narrow cut seam. The sheet flooring product used was Armstrong's Midstar® Resilient Sheet Flooring. The sheets are each formed of a 15 mil PVC wear layer a 20 mil foam inter-layer and a 22 mil non-woven felt backing layer. A hot melt adhesive powder, 5186PE, a polyester adhesive manufactured by Bostick, Inc., was applied over a non-woven polyester mat and heated to coat the mat with a film of the adhesive. The resulting laminate was slit into a ½ in. width tape. The tape was then positioned on the underside of the sheet products beneath the cut seam.

The area of the seam to be adhered was then sandwiched between two pieces of polypropylene release paper. The seam was then heated and pressed in a Wabash press fitted with a tool that allowed heat and pressure to come in conflict with the prepared seam. The press temperature was 110° C. A minimum pressure of 25 psi was applied for 12 seconds. The pressure together with capillary action forced the hot melt adhesive into contact with all of the elements of the sheet flooring products. The sample was then removed from the press and allowed to cool. Upon cooling, the release paper was removed. The seam area was joined to give a tight, well sealed seam.

EXAMPLE NO. 5

Two sections of sheet flooring products were positioned together to form a narrow cut seam. The sheet flooring product used was Armstrong's Midstar® Resilient Sheet Flooring.

A hot melt adhesive 5400AB, a polyester adhesive manufactured by Bostick, Inc. with a melt temperature of approximately 132 to 138° C. was pressed into a sheet 10–12 mils in thickness. This adhesive is formed from the reaction of essentially equal parts of terephthalic and isophthalic acid with 1,4-butanediol. The sheet of hot melt adhesive was then slit into a ½ in. width tape. The adhesive in tape form was then positioned on the underside of the flooring structure beneath the cut seam.

The seam to be adhered was then sandwiched between two pieces of polypropylene release paper. The prepared seam was then heated and pressed in a Wabash press. The press temperature was 132° C. at minimum pressure of 25 psi for 12 seconds.

The pressure together with capillary action forced the hot melt adhesive into contact with all of the elements of the sheet flooring products. The sample was then removed from the press and allowed to cool. Upon cooling, the release paper was removed. The seam area was joined to give a tight, well sealed seam. The joined flooring structure was then tested for breaking strength using FTMS 501A test method. The joined flooring structure exhibited 74% of the strength of the unjoined sheet products. The seamed areas exhibited similar staining and wear characteristics as the PVC wear layer of the sheet flooring product.

EXAMPLE NO. 6

Two sections of sheet flooring products were positioned together to form a narrow cut seam. The sheet flooring product used was Armstrong's Midstar® Resilient Sheet Flooring. The cut edges were then positioned and the pattern was matched. The cut edges were held in place with the aid of an adhesive tape on the underside of the cut edges. A hot melt adhesive 5400AB, a polyester adhesive manufactured by Bostick, Inc. with a melt temperature of approximately 132 to 138° C. in powder form was placed in the seam. The seam to be adhered was then sandwiched between two pieces of polypropylene release paper. The prepared seam was then heated and pressed in a Wabash press. The press temperature was 132° C. with minimum pressure of 25 psi for 12 seconds.

The pressure together with capillary action melted the hot melt adhesive powder and sample was then removed from the press and allowed to cool. Upon cooling, the release paper was removed. The seam area was joined to give a tight, well sealed seam.

EXAMPLE NO. 7

Two sections of sheet flooring products were positioned together to form a narrow cut seam. The sheet flooring product used was Armstrong's Midstar® Resilient Sheet Flooring. A hot melt adhesive 5186PE, a polyester adhesive manufactured by Bostick, Inc., was heated to above its melting temperature in a hot melt glue gun and extruded into the gap created by the cut edges. The prepared seam was then covered with polyethylene release paper and pressure was applied using hand seam roller. The sample was then allowed to cool and the release paper removed. The seam area was joined sufficiently to hold the structure together.

EXAMPLE NO. 8

Two sections of sheet flooring products were positioned together to form a narrow cut seam. The sheet flooring product used was Armstrong's Midstar® Resilient Sheet Flooring. A hot melt adhesive 5186PE, a polyester adhesive manufactured by Bostick, Inc., in the form of a non-woven fibrous scrim sold as PE 103 was slit to a ½ in. width. The gauge of the scrim was between 3 and 5 mils. The scrim was then positioned on the underside of the flooring structure beneath the cut seam. In addition, the scrim was slit to ¼ in. width and a length of the ¼ in. scrim was positioned on top of the cut seam.

The prepared seam was then sandwiched between two pieces of polypropylene release paper. The seam was then heated and pressed in a Wabash press. The press temperature was 132° C. at minimum pressure of 25 psi for 12 seconds.

The pressure together with capillary action melted the hot melt adhesive scrim and forced the hot melt adhesive into contact with all of the elements of the sheet flooring products. The sample was then removed from the press and allowed to cool. Upon cooling, the release paper was removed. The seam area was well joined, including a tight, well sealed top seam.

EXAMPLE NO. 9

Two sections of sheet flooring products were positioned together to form a narrow cut seam. The sheet flooring product used was Armstrong's Midstar® Resilient Sheet Flooring. A polyamide hot melt adhesive sold under the trade name of Stitch Witchery™ (distributed by Prym-Dritz® Corp., Spartanburg, S.C.) in the form of a non-woven fibrous scrim was slit to a ½ in. width. The gauge of the scrim was 13 mils. Two layers of the scrim were then positioned on the underside of the flooring sheets beneath the cut seam. An additional piece of scrim was positioned on top of the cut seam.

The prepared seam was then sandwiched between two pieces of polypropylene release paper. The seam was then heated and pressed in a Wabash press. The press temperature was 132° C. at minimum pressure of 25 psi for 12 seconds.

The pressure together with capillary action melted the hot melt adhesive powder and forced the hot melt adhesive into contact with all of the elements of the sheet flooring products. The sample was then removed from the press and allowed to cool. Upon cooling, the release paper was removed. The seam area was well joined, including a tight, well sealed top seam.

Comparative Example No. 1

Two sections of sheet flooring products were positioned together to form a narrow cut seam, and the visual pattern matched. The sheet flooring product used was Armstrong's Midstar® Resilient Sheet Flooring. An adhesive tape was placed over the seam area on the underside of the seam. A liquid PVC plastisol material comparable to the wear layer chemistry of the sheet flooring products was then applied to the seam area. This material was then fused to the sheet flooring by heating the structure to 177° C. in a Mathis Oven for three minutes. The resulting seam was weak and would not provide the strength needed to move the product through a manufacturing operation. This example thus demonstrates that an adhesive suitable for properly joining the seam to create a preseamed sheet flooring material must have properties substantially greater than the PVC from which the sheet flooring product is produced.

EXAMPLE NO. 10

Joinable edges were made whereby two different sheet products, specifically Armstrong's Modulations® resilient flooring (60 mil gauge) and Armstrong's Safeguard Design resilient flooring (90 mil gauge) were joined at a seam thus creating a new visual pattern. An adhesive tape was placed over the seam area on the underside of the seam. A 2 mm diameter rope of Bostick 5186PE polyester was placed over the cut seam area. The seam was then sandwiched between two sheets of polypropylene release paper. The seam and surrounding material was then pressed in a Wabash Press at 121° C. for 0.7 minutes at minimum pressure of 25 psi. The product was allowed to cool to room temperature and the release paper was removed. The seam area was joined sufficiently to the resilient sheets together and to provide for a completely sealed seam which spanned the 30 mil gauge difference.

EXAMPLE NO. 11

A patterned cut was made into a piece of Armstrong's Modulations® resilient flooring and the cut piece was removed. A second piece of Armstrong Modulations® resilient flooring was cut and fitted precisely into the patterned cut of the first piece, thereby creating an insert and a seam in the shape of the patterned cut. A piece of adhesive tape was then positioned on the underside of the seam to add strength during the seaming process. A polyester tape, specifically Bostick 5186PE (10 mil gauge) pigmented with a pearlescent material was introduced into the patterned shape of the seam. This tape was then positioned over the seam formed by the patterned cut of the resilient flooring. The flooring was then sandwiched between two sheets of polypropylene release paper and pressed in a Wabash press for 0.7 minutes at 121° C. at minimum pressure of 25 psi. The polyester tape completely sealed the seam and formed an indistinct seam aesthetically acceptable to a typical consumer.

EXAMPLE NO. 12

Two sections of sheet flooring products were positioned together to form a narrow cut seam. The sheet flooring product used was Armstrong's Midstar® Resilient Sheet Flooring. A hot melt adhesive polyester sheet made from 5186PE, a polyester adhesive manufactured by Bostick, Inc., was slit into a ½ inch wide tape. The thickness of the tape was between 10 and 12 mils. The tape was positioned on the top surface of the flooring products over the cut seam.

The prepared seam was then sandwiched between two pieces of polypropylene release paper. The prepared seam was then heated and pressed in a Wabash press fitted with a tool that allowed heat and pressure to come in contact with the prepared seam. The press temperature was 110° C. at a pressure of about 25 psi was applied for 12 seconds.

The sample was then removed from the press and allowed to cool. Upon cooling, the release paper was removed. The seam area exhibited a tight, completely sealed seam having sufficient strength to hold the sheet products together.

The foregoing samples demonstrate that certain hot melt adhesives possess properties which permit the permanent joining of resilient flooring sheets, including those made of PVC materials, and that such adhesives also possess staining and wear properties which generally coincide with the staining and wear properties of PVC resilient flooring products.

A preseamed sheet flooring product and method of constructing a preseamed sheet flooring product is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A preseamed sheet flooring product, comprising:

(a) first and second composite sheet products positioned closely adjacent each other edge-to-edge to form a seam therebetween;

(b) an adhesive positioned in the seam, extending completely through the thickness of said sheet flooring product and bonding with said first and second sheet products through the entire thickness thereof, said adhesive having visual characteristics suitable for creating an indistinct appearance of the seam in the sheet flooring product and also having wear characteristics suitable for sufficiently similar to wear characteristics of the sheet flooring product to maintain the visually indistinct appearance of the adhesive on the surface of the seam as wear occurs to the sheet flooring product, thereby creating a finished seam sufficiently strong and flexible to permit the adhesive to be positioned in the seam prior to rolling the flooring product for shipment and storage, and prior to installation of the flooring product on a subfloor surface; and (c) a backing layer positioned on one major surface of each of said sheet products, said backing layer without an adhesive coating applied to a substantial portion of the backing layer surface opposite the sheet product.

2. A sheet flooring product according to claim 1, wherein said flooring product is in roll-form.

3. A sheet flooring product according to claim 1, wherein the adhesive comprises a hot melt adhesive.

4. A sheet flooring product according to claim 1, wherein the edges of the first and second sheet products are shaped to define, when positioned closely adjacent each other, a predetermined void within the seam for retaining the adhesive therein.

5. A sheet flooring product according to claim 1, wherein the seam between the first and second sheet products is between 10 and 100 microns in width.

6. A sheet flooring product according to claim 1, wherein each of said first and second sheet products further comprises a wear layer and an interlayer.

7. A sheet flooring product according to claim 6, wherein said wear layer comprises PVC.

8. A sheet flooring product according to claim 1, wherein said adhesive comprises a hot melt adhesive applied to the seam in a form selected from the group consisting of tape form, powder form, scrim form and rope form, and further wherein said adhesive is forced into the seam by heat and pressure.

9. A sheet flooring product according to claim 1, wherein said adhesive comprises a hot melt adhesive applied to the seam in a form selected from the group consisting of tape form, powder form, scrim form and rope form, and further wherein said adhesive is exposed to sufficient heat and pressure to initiate capillary flow of the adhesive into the seam.

* * * * *

UNITED STATES PATENT AND TRADEMARK OFFICE

CERTIFICATE OF CORRECTION

PATENT NO. : 6,326,073 B1
DATED : December 4, 2001
INVENTOR(S) : Sager et al.

It is certified that error appears in the above-identified patent and that said Letters Patent is hereby corrected as shown below:

Column 12,
Line 12, delete “suitable for”.
Line 15, delete “suitable for”.

Signed and Sealed this

Eleventh Day of March, 2003

JAMES E. ROGAN
*Director of the United States Patent and Trademark Office*